US010605461B2

(12) United States Patent
Cadima

(10) Patent No.: US 10,605,461 B2
(45) Date of Patent: Mar. 31, 2020

(54) COOKTOP APPLIANCE WITH A GAS BURNER ASSEMBLY

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 175 days.

(21) Appl. No.: 15/814,457

(22) Filed: Nov. 16, 2017

(65) Prior Publication Data

US 2019/0145626 A1 May 16, 2019

(51) Int. Cl.

| | |
|---|---|
| ***F24C 3/00*** | (2006.01) |
| ***F24C 3/08*** | (2006.01) |
| ***F23D 14/58*** | (2006.01) |
| ***F23D 14/62*** | (2006.01) |
| ***F23D 14/06*** | (2006.01) |

(52) U.S. Cl.

CPC ..... *F24C 3/085* (2013.01); *F23D 14/06* (2013.01); *F23D 14/065* (2013.01); *F23D 14/58* (2013.01); *F23D 14/62* (2013.01); *F23D 2900/14061* (2013.01)

(58) Field of Classification Search

CPC ..... F24C 3/08; F24C 3/082; F24C 3/085
USPC ..... 126/39 R, 39 E
See application file for complete search history.

(56) References Cited

U.S. PATENT DOCUMENTS

| | | | | |
|---|---|---|---|---|
| 9,151,494 | B2 | 10/2015 | Quintaba' et al. | |
| 9,541,294 | B2 | 1/2017 | Angulo | |
| 2008/0202494 | A1* | 8/2008 | Paesani | F23D 14/065 126/39 E |
| 2015/0040887 | A1* | 2/2015 | Angulo | F24C 3/08 126/39 E |

* cited by examiner

*Primary Examiner* — Vivek K Shirsat
(74) *Attorney, Agent, or Firm* — Dority & Manning, P.A.

(57) ABSTRACT

A cooktop appliance includes a top panel. A gas burner assembly includes an annular burner body positioned on the top panel at a top surface of the top panel. The annular burner body defines a central combustion zone. The annular burner body also defines a plurality of flame ports at the central combustion zone. Gaseous fuel is flowable from a fuel chamber within the annular burner body into the central combustion zone through the plurality of flame ports. The gas burner assembly further includes features for direction the gaseous fuel into the fuel chamber of the annular burner body. The annular burner body is open at the central combustion zone such that the top panel is exposed through the annular burner body at the central combustion zone.

20 Claims, 12 Drawing Sheets

COOKTOP APPLIANCE WITH A GAS BURNER ASSEMBLY

FIELD OF THE INVENTION

The present subject matter relates generally to cooktop appliances with gas burner assemblies, such as gas range appliances or gas stove appliances.

BACKGROUND OF THE INVENTION

Certain cooktop appliances include gas burners for heating cooking utensils on the cooktop appliances. Gas burners that fire inwards, typically with a swirling flame pattern, offer better efficiency than traditional outward firing gas burners. However, known inward firing gas burners have various drawbacks.

One problem with known inward firing gas burners is that a center of the inward firing gas burners is open. A portion of the top panel below the open center is perforated to allow components of the inward firing gas burners to pass through the top panel, but spills can also pass through the perforated top panel. Such spills can be difficult to clean. Other known inward firing gas burners have components, such as surfaces, passages and channels, at a center of the inward firing gas burner. Spills frequently collect on such components and are difficult to clean. The spills can also stain the components, particularly when the components are formed of porous cast metal, and stains are unsightly. Directing secondary combustion air through the inward firing gas burners can also be difficult.

Accordingly, a cooktop appliance with features for limiting spills from passing through a top panel of the cooktop appliance would be useful. In addition, a cooktop appliance with features for limiting spills from passing through a top panel of the cooktop appliance that also includes features for supplying secondary combustion air to a gas burner assembly would be useful.

Another problem with known inward firing gas burners is inherent pooling of gaseous fuel within the gas burners when the gaseous fuel is allowed to flow out without immediate ignition, i.e., a delayed ignition scenario. Delayed ignition scenarios can result in an ignition "pop" noise as the accumulated excess gaseous fuel rapidly burns once ignited. This most frequently occurs when the gaseous fuel is heavier than air, e.g., propane. The heavy gaseous fuel tends to sink and collect within the gas burner rather than floating away, and the annular wall of the inward firing gas burners helps collect the gaseous fuel rather than dissipate it.

Accordingly, a cooktop appliance with features for limiting pooling of gaseous fuel within a gas burner would be useful. In particular, a cooktop appliance with features for limiting pooling of gaseous fuel within an inward firing gas burner in order to reduce the audible magnitude of the ignition "pop" in delayed ignition scenarios would be useful.

BRIEF DESCRIPTION OF THE INVENTION

The present subject matter provides a cooktop appliance with a top panel. A gas burner assembly includes an annular burner body positioned on the top panel at a top surface of the top panel. The annular burner body defines a central combustion zone. The annular burner body also defines a plurality of flame ports at the central combustion zone. Gaseous fuel is flowable from a fuel chamber within the annular burner body into the central combustion zone through the plurality of flame ports. The gas burner assembly further includes features for direction the gaseous fuel into the fuel chamber of the annular burner body. The annular burner body is open at the central combustion zone such that the top panel is exposed through the annular burner body at the central combustion zone. Additional aspects and advantages of the invention will be set forth in part in the following description, or may be apparent from the description, or may be learned through practice of the invention.

In a first example embodiment, a cooktop appliance includes a top panel. A gas burner assembly is positioned at the top panel. The gas burner assembly includes an annular burner body positioned on the top panel at a top surface of the top panel. The annular burner body defines a central combustion zone. The annular burner body also defines a plurality of flame ports at the central combustion zone. Gaseous fuel is flowable from a fuel chamber within the annular burner body into the central combustion zone through the plurality of flame ports. The gas burner assembly further includes a fuel manifold. The annular burner body connectable to the fuel manifold such that the gaseous fuel is flowable from the fuel manifold into the fuel chamber of the annular burner body. The fuel manifold having a plurality of outlet passages and a horizontal Venturi mixing tube. The gaseous fuel is flowable through the plurality of outlet passages into the fuel chamber of the annular burner body. The horizontal Venturi mixing tube has an inlet positioned at one side portion of the fuel manifold and an outlet positioned at an opposite side portion of the fuel manifold. The annular burner body is open at the central combustion zone such that the top panel is exposed through the annular burner body at the central combustion zone.

In a second example embodiment, a cooktop appliance includes a top panel. A gas burner assembly is positioned at the top panel. The gas burner assembly includes an annular burner body positioned on the top panel at a top surface of the top panel. The annular burner body defines a central combustion zone. The annular burner body extends around the central combustion zone. The annular burner body also defines a plurality of flame ports at the central combustion zone. Gaseous fuel is flowable from a fuel chamber within the annular burner body into the central combustion zone through the plurality of flame ports. An inlet passage extends from the annular burner body. The gaseous fuel is flowable into the fuel chamber of the annular burner body through the inlet passage. A fuel nozzle bracket is mounted to the top panel at a bottom surface of the top panel. An outlet passage extends from the fuel nozzle bracket through the top panel towards the annular burner body. The outlet passage is coupled to the inlet passage such that the gaseous fuel is flowable through the outlet passage into the fuel chamber of the annular burner body through the inlet passage. The annular burner body is open at the central combustion zone such that the top panel is exposed through the annular burner body at the central combustion zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
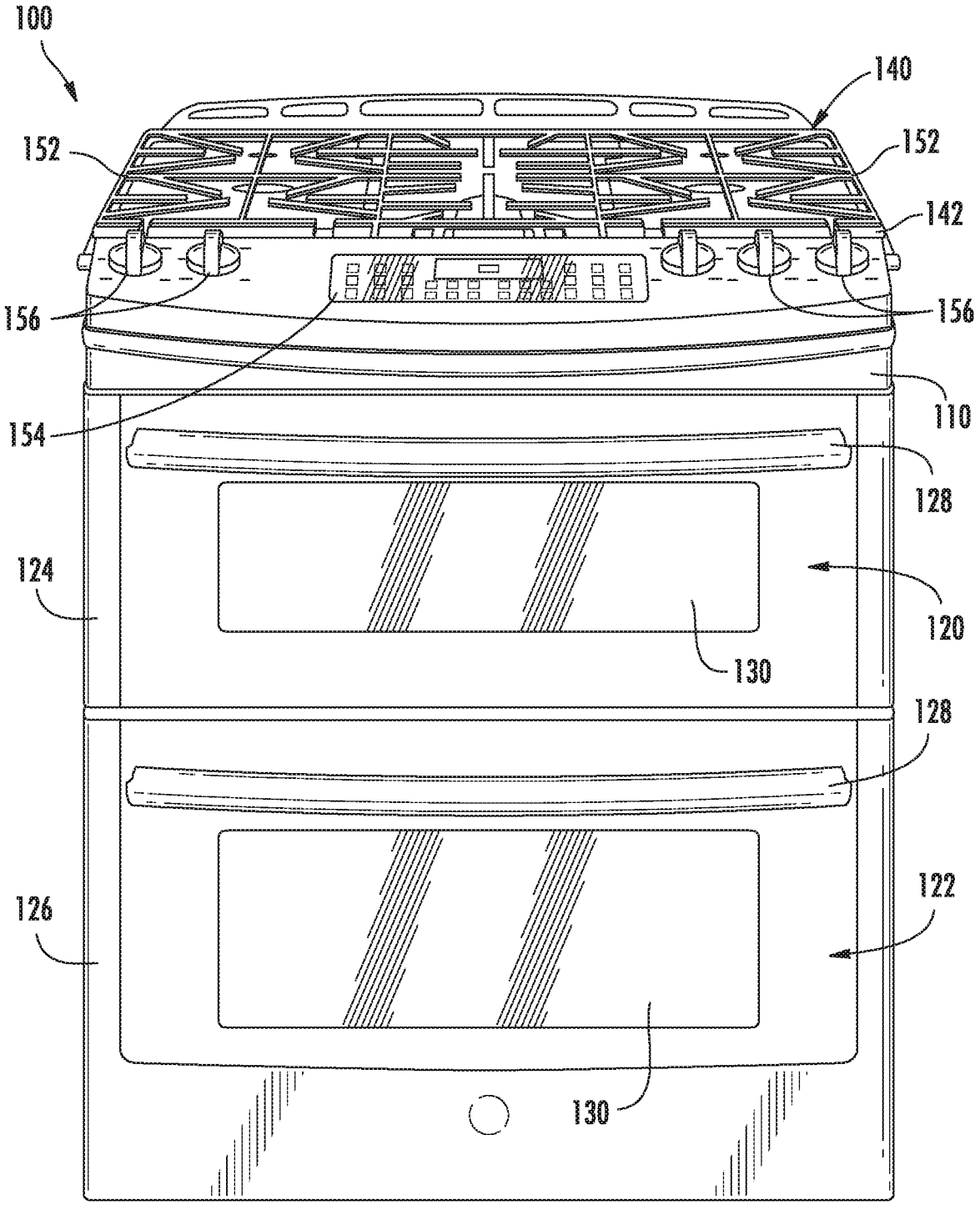
FIG. 1 provides a front, perspective view of a range appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
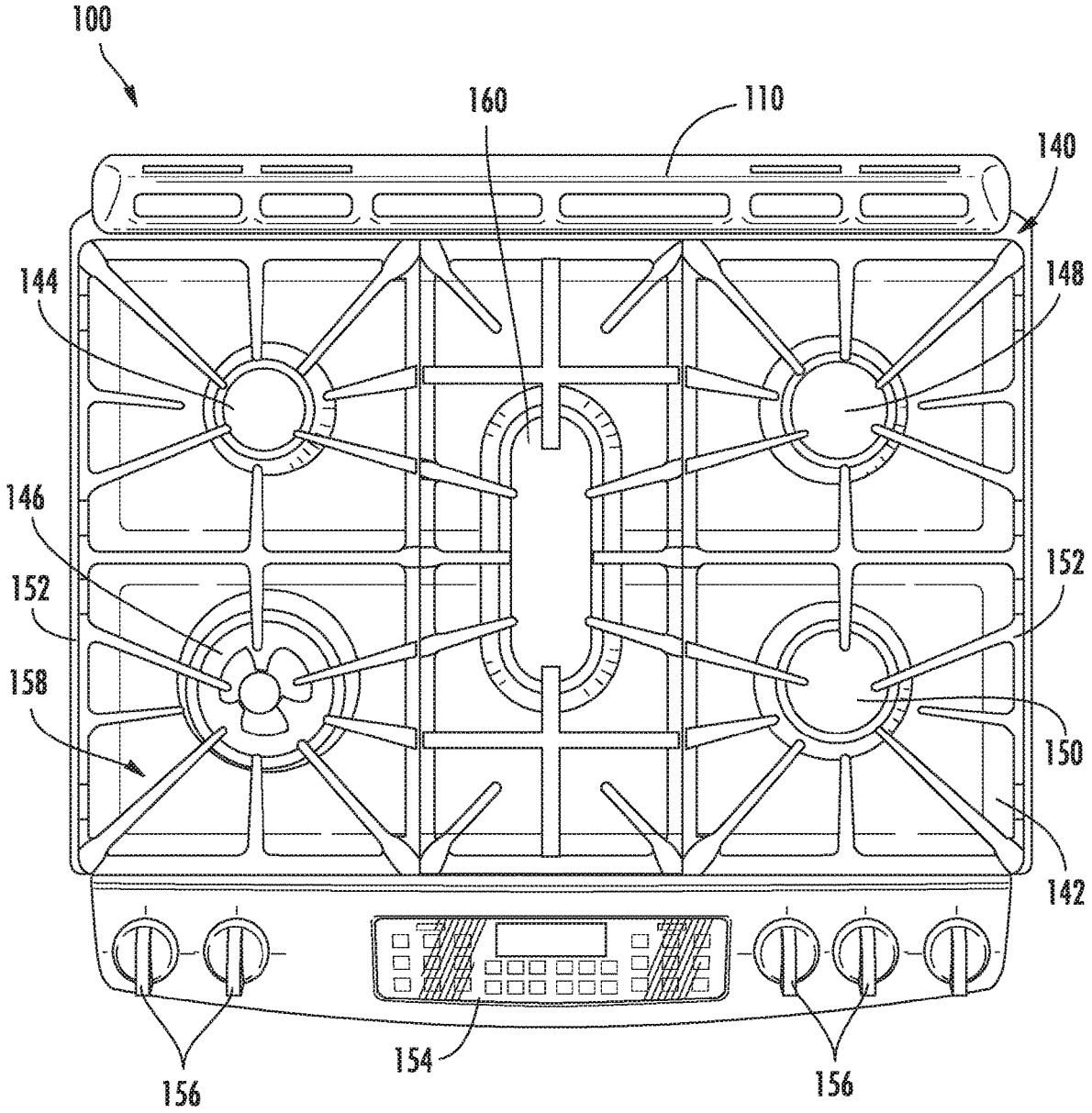
FIG. 2 provides a top, plan view of the example range appliance of FIG. 1.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the example embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
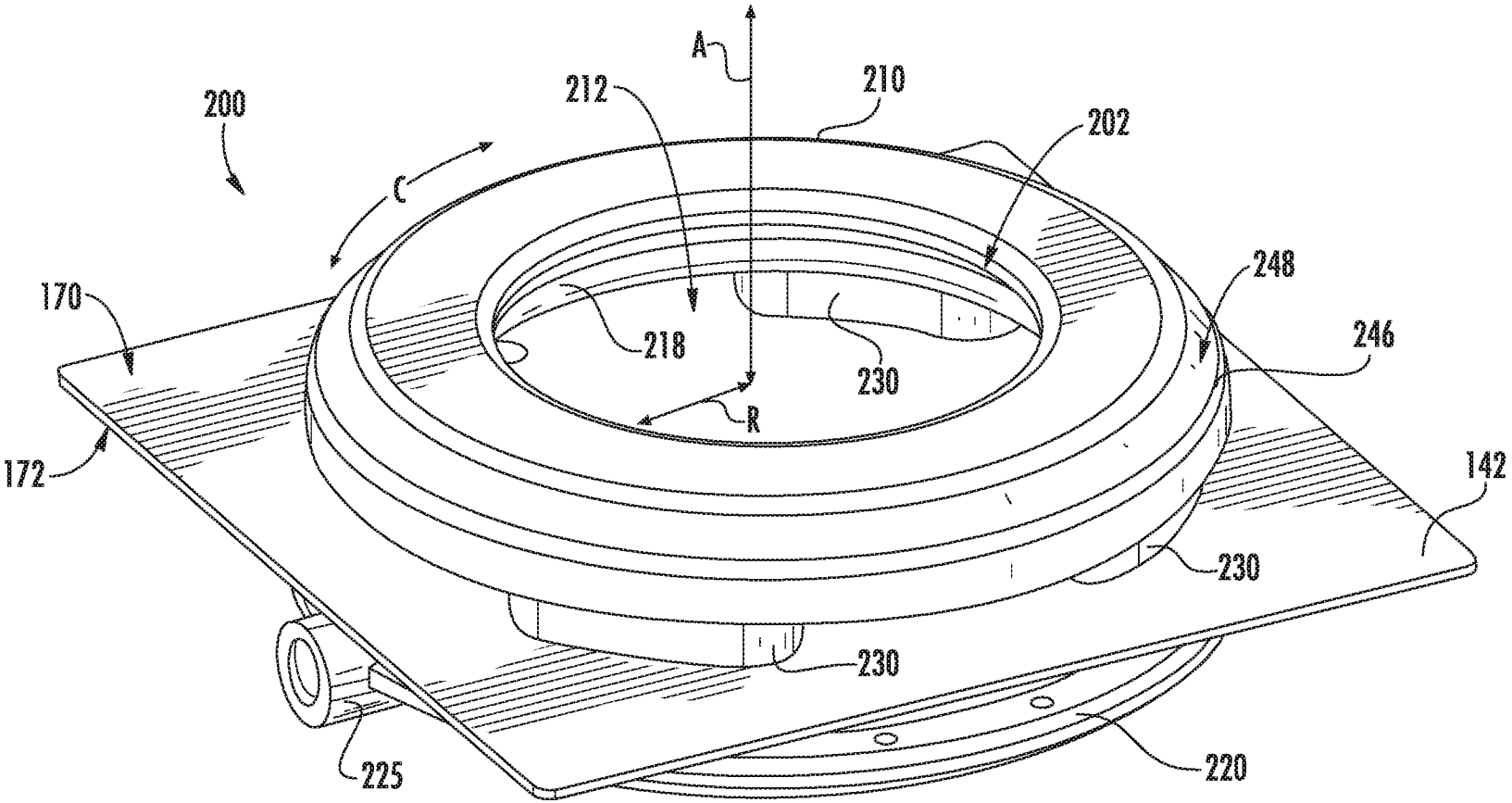
FIG. 3 provides a partial, perspective view of a top panel and a gas burner assembly according to an example embodiment of the present subject matter.
Figure 4:
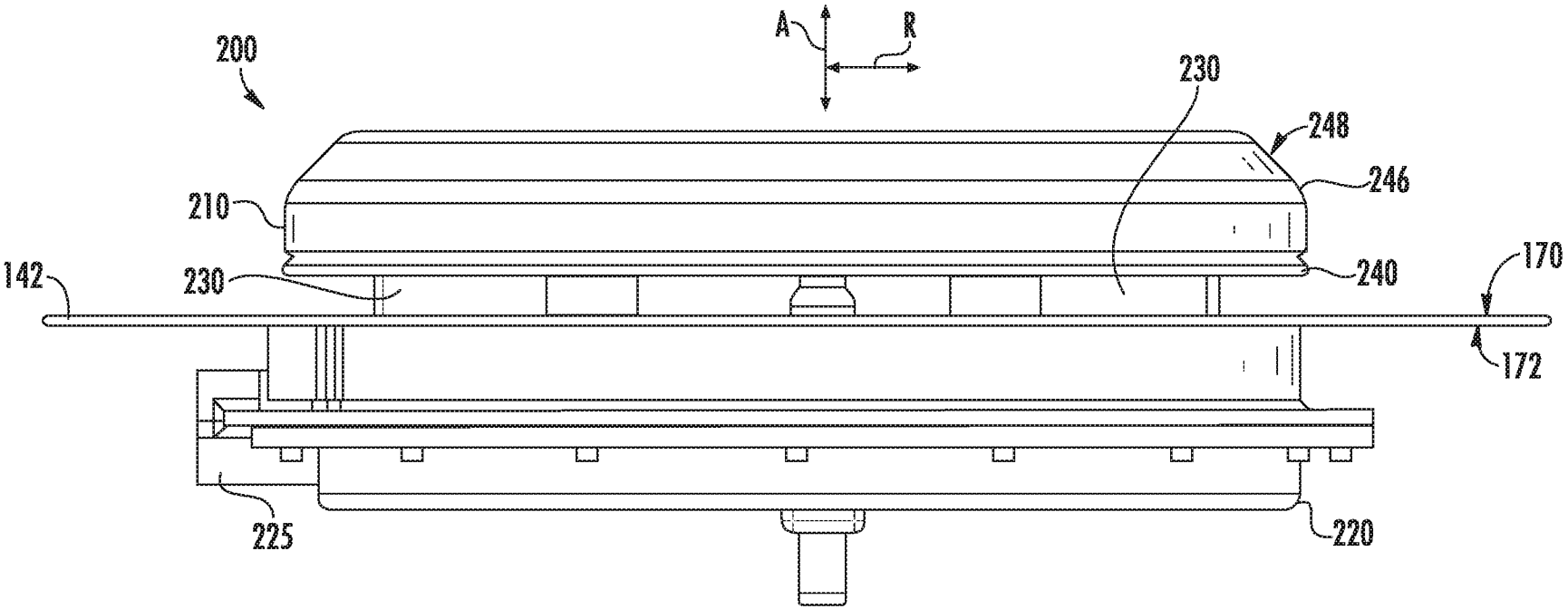
FIG. 4 provides a side, elevation view of the top panel and the example gas burner assembly of FIG. 3.
Figure 5:
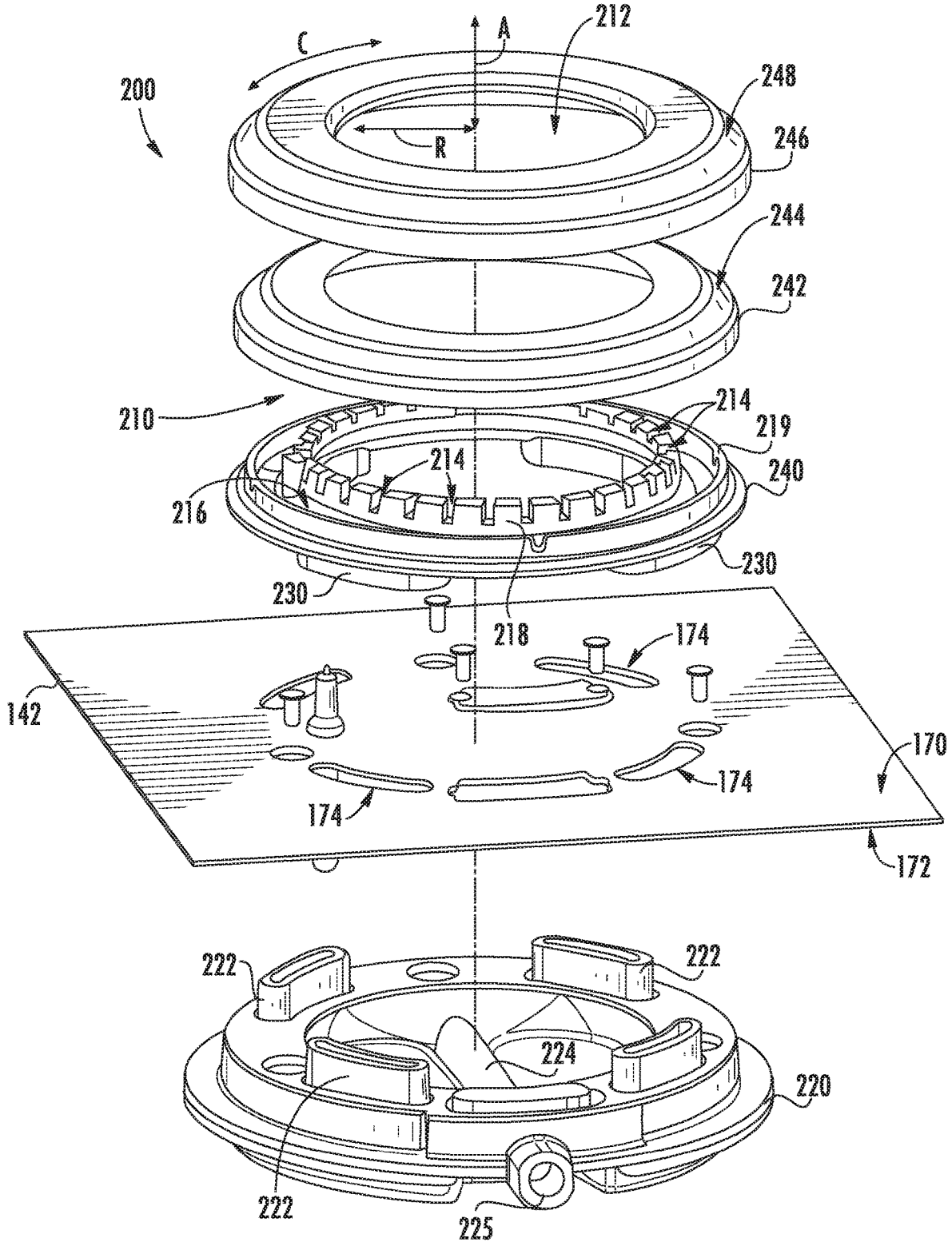
FIG. 5 provides an exploded, perspective view of the top panel and the example gas burner assembly of FIG. 3.

FIG. 3 provides a partial, perspective view of top panel 142 and a gas burner assembly 200 according to an example embodiment of the present subject matter. FIG. 4 provides a side, elevation view of top panel 142 and gas burner assembly 200. FIG. 5 provides an exploded, perspective view of top panel 142 and gas burner assembly 200. As an example, burner assembly 200 may be used in range appliance 100 (FIG. 2) as one of burner assemblies 144, 146, 148, 150. However, it will be understood that, while describe in greater detail below in the context of range appliance 100, burner assembly 200 may be used in or with any suitable appliance in alternative example embodiments. As may be seen in FIG. 3, burner assembly 200 includes an inner burner ring 202. Inner burner ring 202 may be inward firing with a swirling flame pattern. As discussed in greater detail below, burner assembly 200 includes features for assisting with cleaning food spills on or below burner assembly 200. Burner assembly 200 defines an axial direction A, a radial direction R and a circumferential direction C.

In FIG. 3, burner assembly 200 is positioned at top panel 142. As shown in FIGS. 3 through 5, burner assembly 200 includes an annular burner body 210. Annular burner body 210 is positioned on top panel 142 at a top surface 170 of top panel 142. For example, annular burner body 210 may rest one top panel 142 at top surface 170 of top panel 142 such that annular burner body 210 is not fastened or otherwise mechanically fixed to top panel 142. Thus, a user may simply lift annular burner body 210 upwardly away from top panel 142 to remove annular burner body 210 from top panel 142.

Annular burner body 210 defines a central combustion zone 212. Annular burner body 210 also defines a plurality of flame ports 214, e.g., at or facing central combustion zone 212. Flame ports 214 may be distributed, e.g., along the circumferential direction C, about central combustion zone 212. Gaseous fuel is flowable from a fuel chamber 216 within annular burner body 210 into central combustion zone 212 through flame ports 214. Flame ports 214 may also be oriented such that the gaseous fuel flows in a swirling pattern from flame ports 214 into central combustion zone 212. As may be seen in FIG. 5, annular burner body 210 may include an inner side wall 218 and an outer side wall 219. Inner side wall 218 may extend around central combustion zone 212, e.g., along the circumferential direction C. Flame ports 214 may be formed on or extend through inner side wall 218, e.g., along the radial direction R, between fuel chamber 216 and central combustion zone 212. Outer side wall 219 may extend around inner side wall 218, e.g., along the circumferential direction C. Outer side wall 219 may also be spaced from inner side wall 218, e.g., along the radial direction R. Fuel chamber 216 may be defined and positioned between inner and outer side walls 218, 219, e.g., along the radial direction R, within annular burner body 210.

Annular burner body 210 is open at central combustion zone 212. Thus, e.g., no portion or component of annular burner body 210 may extend, e.g., along the radial direction R, into central combustion zone 212. Top panel 142 may be exposed through annular burner body 210 at central combustion zone 212. In such a manner, spills from utensils above burner assembly 200 may flow through central combustion zone 212 to top panel 142, and such spills may pass through burner assembly 200 without contacting burner assembly 200 at central combustion zone 212. Staining of annular burner body 210 may be reduced or limited by allowing spills to pass through annular burner body 210 at central combustion zone 212.

Top panel 142 may also be continuous and/or imperforate directly below central combustion zone 212. Thus, spills passing through central combustion zone 212 may collect on top panel 142 and not flow through top panel 142. A user may easily access and clean such spills on top panel 142 by removing annular burner body 210 from top panel 142. In such a manner, burner assembly 200 may facilitate cleaning of spills from utensils positioned over burner assembly 200.

Burner assembly 200 also includes a fuel manifold 220. Fuel manifold 220 is mounted to top panel 142, e.g., with fasteners, at a bottom surface 172 of top panel 142. Thus, fuel manifold 220 may be positioned opposite annular burner body 210 on or about top panel 142. Annular burner body 210 is connectable to fuel manifold 220 such that the gaseous fuel is flowable from fuel manifold 220 into fuel chamber 216 of annular burner body 210. For example, fuel manifold 220 has a plurality of outlet passages 222. The gaseous fuel is flowable from fuel manifold 220 through outlet passages 222 into fuel chamber 216 of annular burner body 210.

Figure 6:
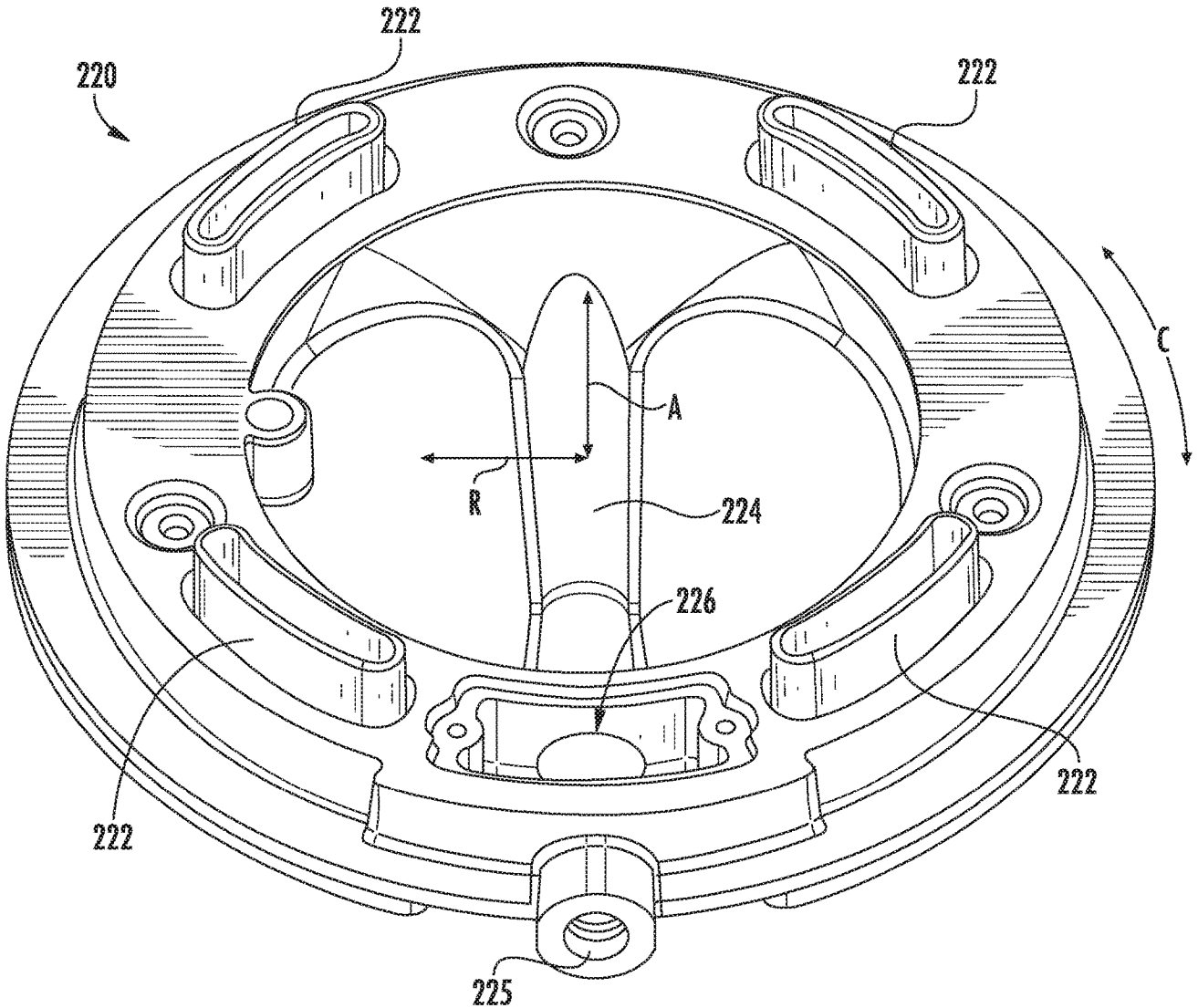
FIG. 6 provides a perspective view of a fuel manifold of the example gas burner assembly of FIG. 3.
Figure 7:
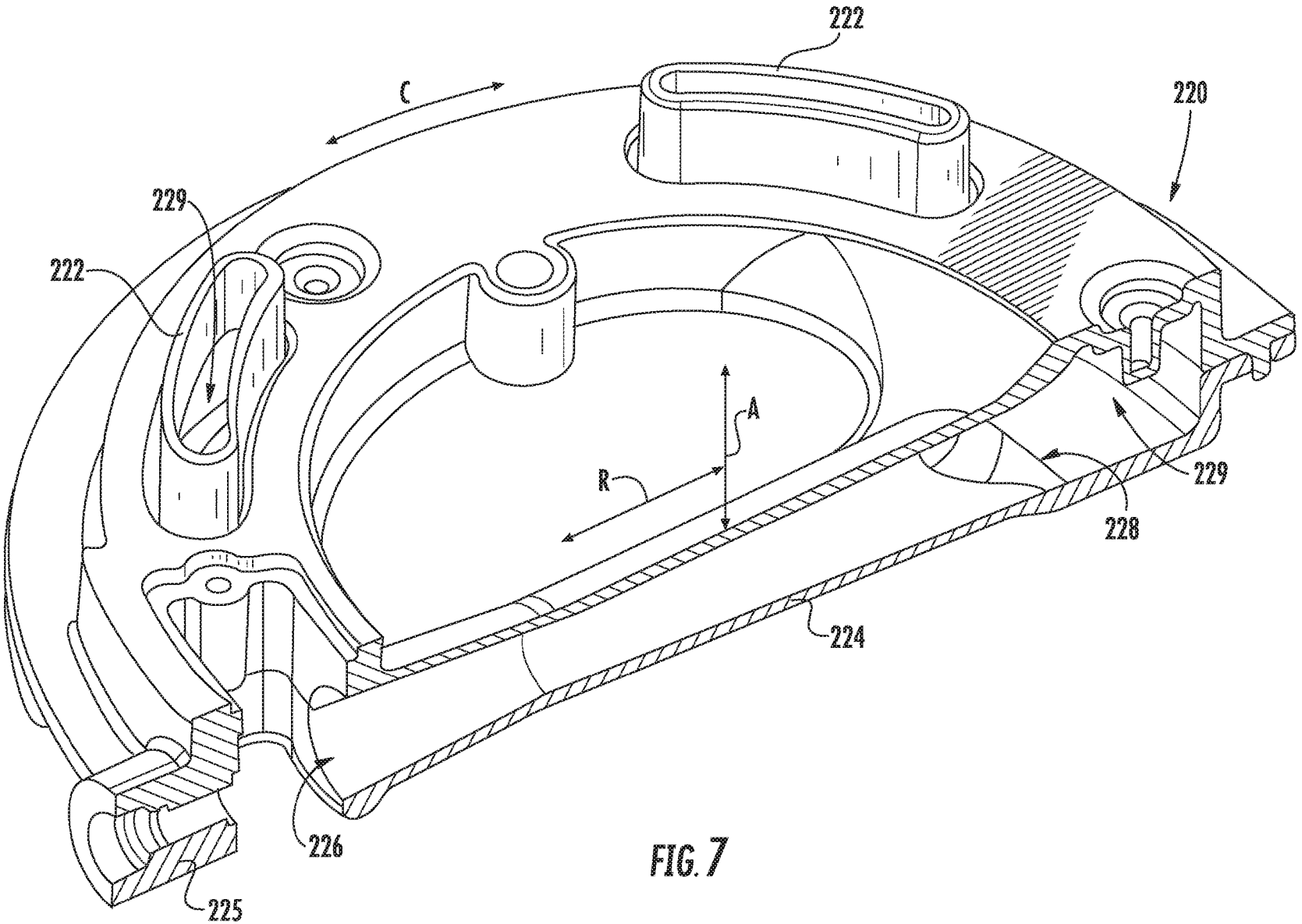
FIG. 7 provides a section view of the fuel manifold of the example gas burner assembly of FIG. 3.
Figure 8:
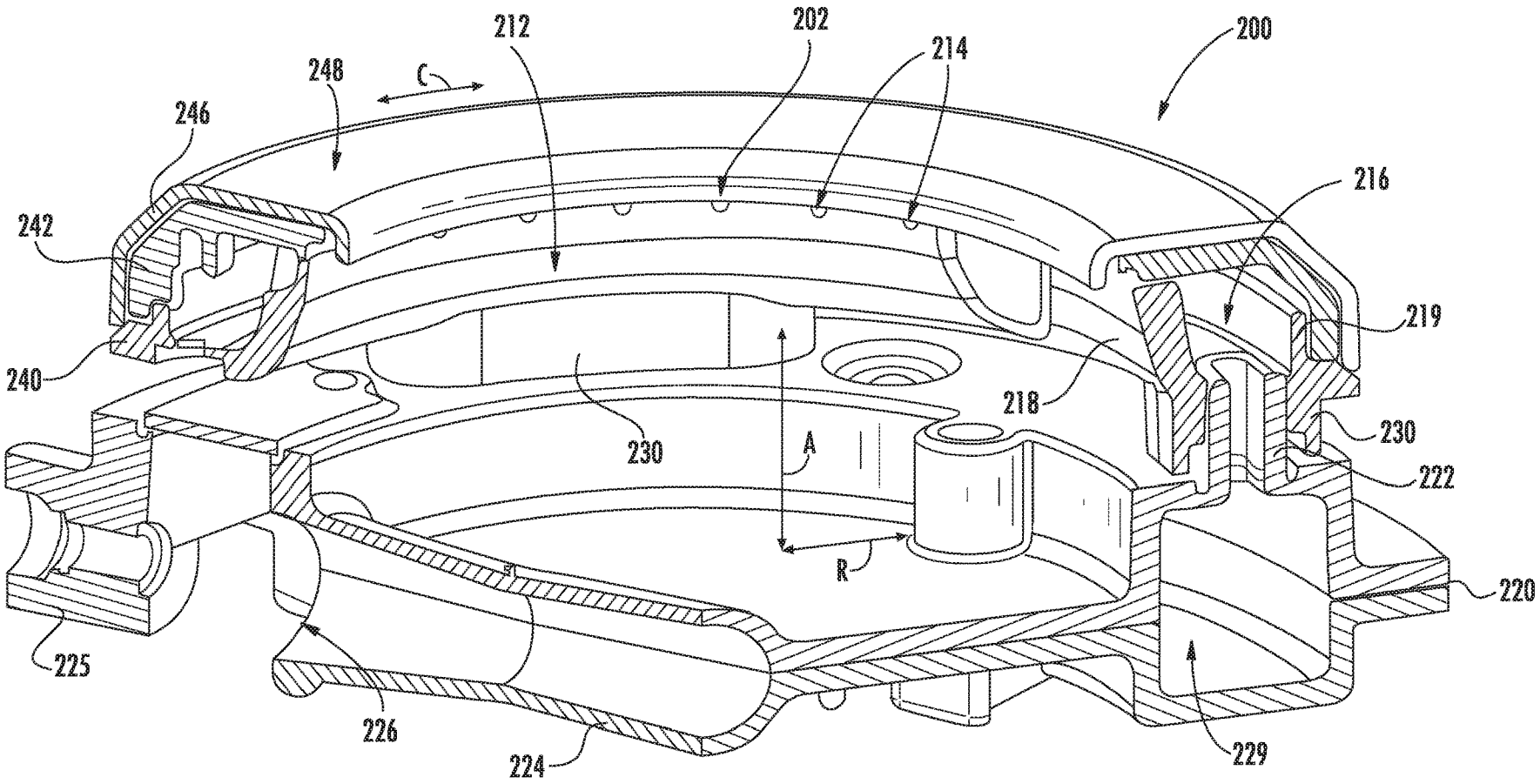
FIG. 8 provides another section view of the fuel manifold of the example gas burner assembly of FIG. 3.
Figure 9:
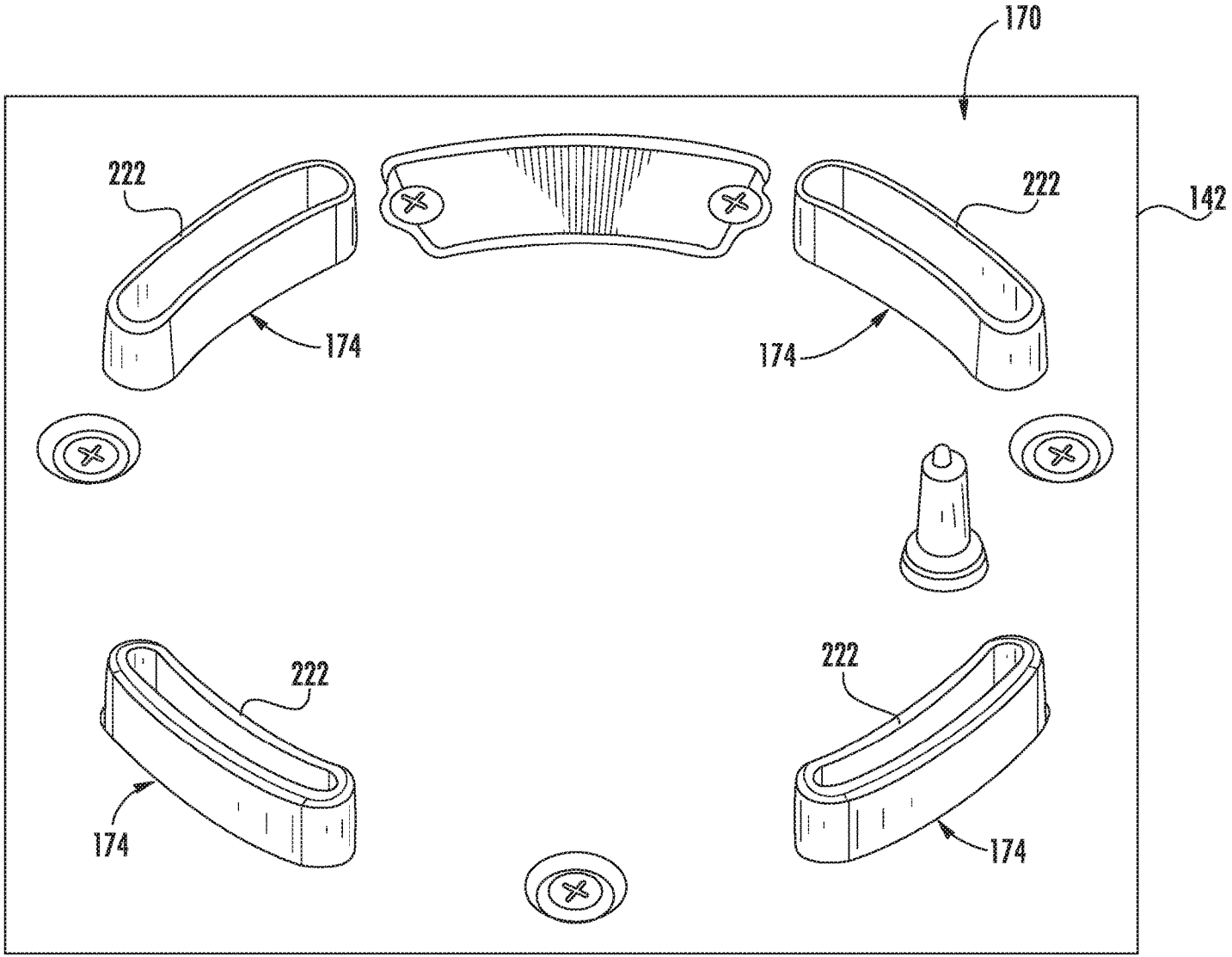
FIG. 9 provides a perspective view of the top panel and outlet passages of the example gas burner assembly of FIG. 3.

FIG. 6 provides a perspective view of fuel manifold 220. FIG. 7 provides a section view of fuel manifold 220. FIG. 8 provides another section view of fuel manifold 220. FIG. 9 provides a perspective view of top panel 142 and outlet passages 222. As may be seen in FIGS. 6 through 8, fuel manifold 220 has a horizontal Venturi mixing tube 224. Horizontal Venturi mixing tube 224 has an inlet 226 and an outlet 228. Inlet 226 of horizontal Venturi mixing tube 224 may be positioned at one side portion of fuel manifold 220, and outlet 228 of horizontal Venturi mixing tube 224 may be positioned at an opposite side portion of fuel manifold 220. Thus, horizontal Venturi mixing tube 224 may extend across fuel manifold 220, e.g., along the radial direction R, and inlet and outlet 226, 228 of horizontal Venturi mixing tube 224 may be positioned opposite each other on fuel manifold 220.

A fuel nozzle (not shown) may be positioned at and oriented towards inlet 226 of horizontal Venturi mixing tube 224. In particular, the fuel nozzle may be mounted to a fuel nozzle bracket 225, e.g., such that the fuel nozzle is spaced from inlet 226 of horizontal Venturi mixing tube 224, e.g., along the radial direction R. The fuel nozzle may be connected to a supply line for gaseous fuel, such as propane or natural gas, and the gaseous fuel may flow from the fuel nozzle to inlet 226 of horizontal Venturi mixing tube 224. Between the fuel nozzle and inlet 226 of horizontal Venturi mixing tube 224, the gaseous fuel may entrain air, and the gaseous fuel may mix with the entrained air within horizontal Venturi mixing tube 224. The mixture of the gaseous fuel and air may exit horizontal Venturi mixing tube 224 at outlet 228 of horizontal Venturi mixing tube 224 and flow into an annular mixing chamber 229 within fuel manifold 220. Annular mixing chamber 229 is in fluid communication with outlet passages 222 such that the mixture of the gaseous fuel and air may flow from annular mixing chamber 229 into outlet passages 222. Thus, outlet passages 222 may extend upwardly, e.g., along the axial direction A, from annular mixing chamber 229.

Outlet passages 222 may be distributed and/or sized to facilitate uniform flow of the gaseous fuel from flame ports 214. For example, outlet passages 222 may be, e.g., uniformly, distributed about central combustion zone 212. In addition, outlet passages 222 positioned proximate or closest to outlet 228 of horizontal Venturi mixing tube 224 may have a smaller outlet area, e.g., in a plane that is perpendicular to the axial direction A, than outlet passages 222 positioned proximate or closest to inlet 226 of horizontal Venturi mixing tube 224. Thus, the sizing of outlet passages 222 may be selected such that outlet passages 222 positioned proximate or closest to outlet 228 of horizontal Venturi mixing tube 224 are smaller than other outlet passages 222. Such relative sizing between outlet passages 222 may address velocity and/or pressure differences of the mixture of the gaseous fuel and air within annular mixing chamber 229.

As may be seen in FIG. 9, outlet passages 222 may extend through top panel 142, e.g., along the axial direction A, from fuel manifold 220 towards annular burner body 210. In particular, top panel 142 defines a plurality of openings 174. Each outlet passage 222 is received within and extends through a respective one of openings 174 of top panel 142. Thus, each opening 174 of top panel 142 is aligned with a respective outlet passage 222. Each opening 174 of top panel 142 may also be sized complementary with the respective outlet passage 222. Such sizing of openings 174 and outlet passages 222 may reduce leakage of spills through top panel 142.

Turning back to FIGS. 3 and 4, burner assembly 200 also includes a plurality of inlet passages 230. Inlet passages 230 extend downwardly, e.g., along the axial direction A, from annular burner body 210 towards top panel 142. As shown in FIG. 8, each inlet passage 230 may engage, e.g., be received on and/or over, a respective outlet passage 222. Thus, the gaseous fuel is flowable from outlet passages 222 of fuel manifold 220 into fuel chamber 216 of annular burner body 210 through inlet passages 230. Outlet passages 222 and inlet passages 230 may form flow paths for the gaseous fuel between fuel manifold 220 and annular burner body 210.

As shown in FIGS. 3 and 4, annular burner body 210 may also be suspended over top panel 142 on inlet passages 230. In particular, inlet passages 230 may extend, e.g., along the axial direction A, from annular burner body 210 to top panel 142 such that ends of inlet passages 230 rest on top panel 142 and annular burner body 210 is spaced from top panel 142, e.g., along the axial direction A. With annular burner body 210 suspended over top panel 142, secondary combustion air is flowable under annular burner body 210, e.g., along the radial direction R, into central combustion zone 212. The secondary combustion air can facilitate clean and efficient combustion of the gaseous fuel from flame ports 214 within central combustion zone 212.

Turning now to FIG. 5, annular burner body 210 may include an annular burner base 240 and an annular burner head 242. Annular burner base 240 includes inlet passages 230 and may be positioned on or over top panel 142. Annular burner head 242 may be positioned on annular burner base 240 to form fuel chamber 216 of annular burner body 210. Thus, e.g., annular burner base 240 may form a bottom wall of fuel chamber 216, and annular burner head 242 may form a top wall of fuel chamber 216. Annular burner base 240 and/or annular burner head 242 may be formed of or with bronze or a cast metal, such as cast iron or cast aluminum.

Annular burner body 210 may also include an annular burner cap 246. Annular burner cap 246 may be positioned on annular burner head 242 such that annular burner cap 246 covers annular burner head 242. Annular burner cap 246 may reduce staining of annular burner base 240 and/or annular burner head 242. For example, annular burner cap 246 may include an enamel coating on an outer surface 248 of annular burner cap 246, e.g., that faces away from annular burner head 242 and is visible to a user of burner assembly 200 when burner assembly 200 is positioned on top panel 142. The enamel coating on annular burner cap 246 may be easier to clean than and less stainable by spills from cooking utensils than the cast metal of annular burner base 240 and/or annular burner head 242.

Figure 10:
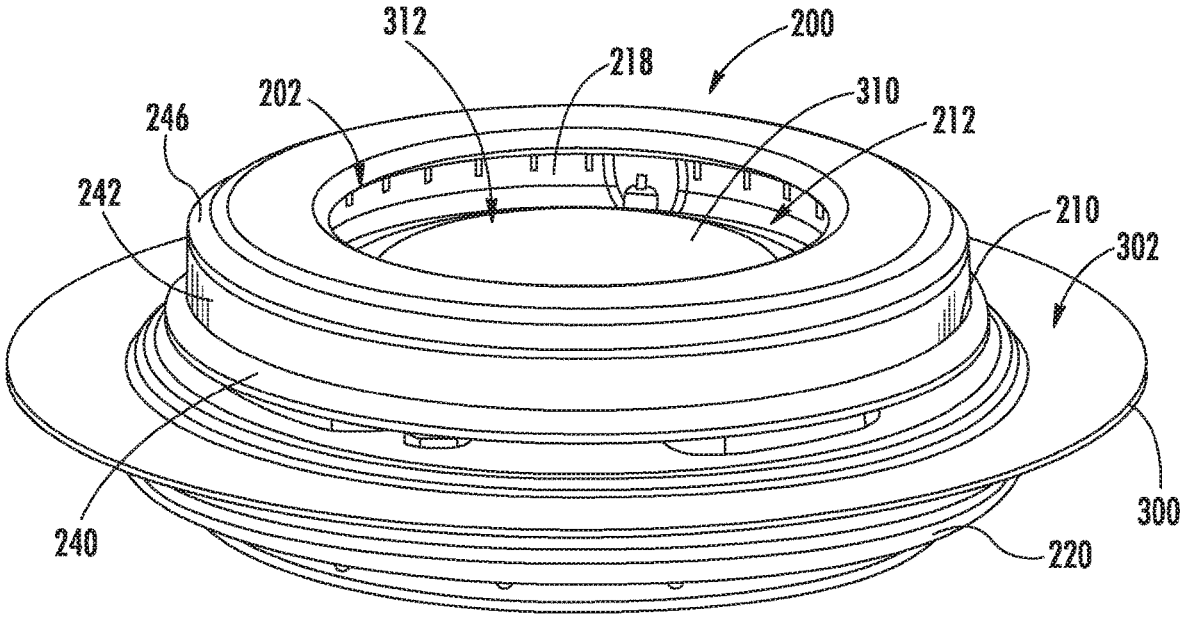
FIG. 10 provides a partial, perspective view of a top panel according to another example embodiment of the present subject matter with the example gas burner assembly of FIG. 3.
Figure 11:
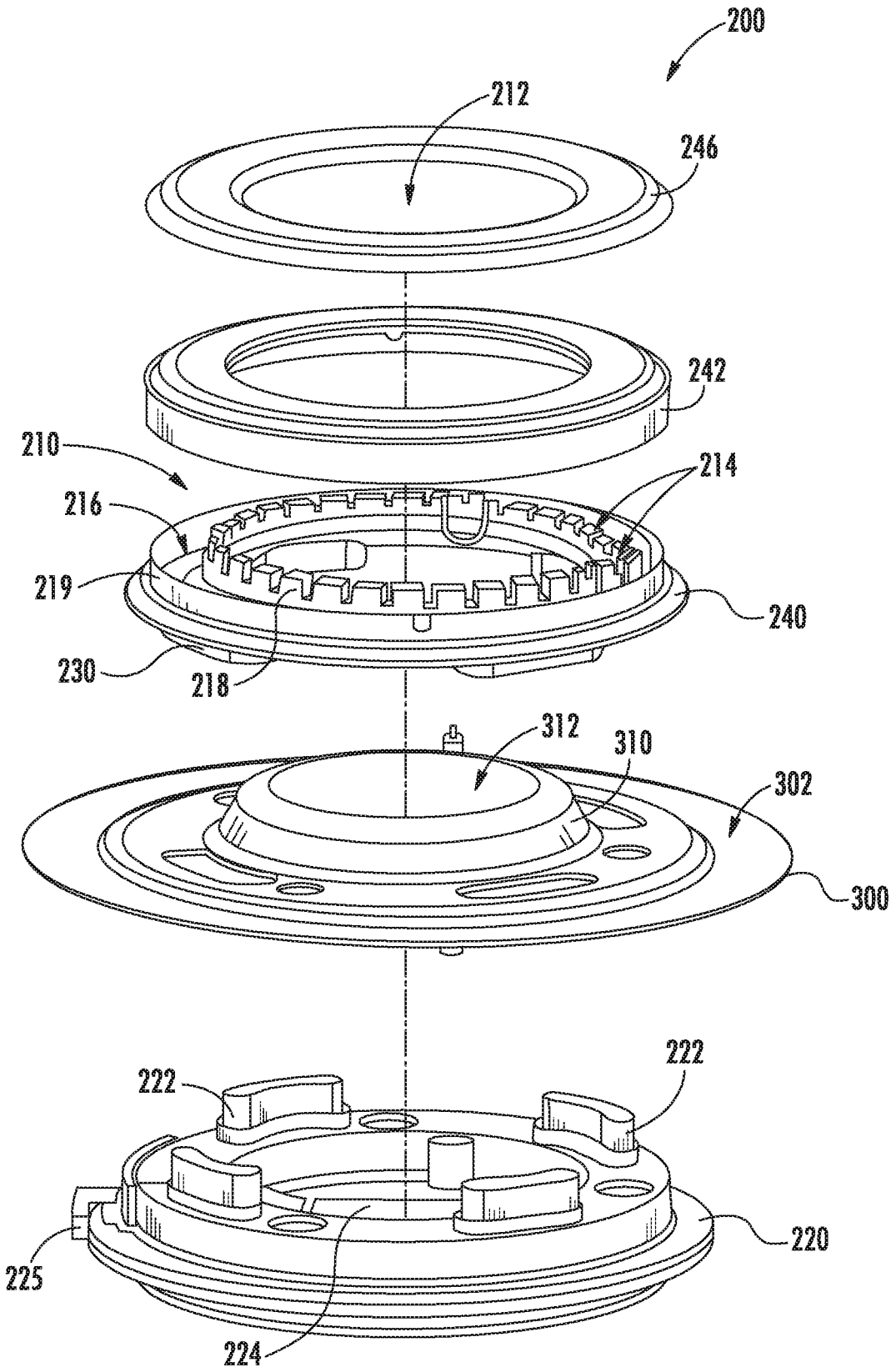
FIG. 11 provides an exploded, perspective view of the example top panel and gas burner assembly of FIG. 10.

FIGS. 10 and 11 show burner assembly 200 used with a top panel 300 according to another example embodiment of the present subject matter. Top panel 300 includes features for limiting pooling of gaseous fuel within central combustion zone 212, e.g., prior to ignition of the gaseous fuel. Thus, top panel 300 may assist with reducing an ignition "pop" noise resulting from accumulated excess gaseous fuel within central combustion zone 212, e.g., relative to top panel 142.

As may be seen in FIGS. 10 and 11, top panel 300 has a projection 310. Projection 310 extends upwardly from a top surface 302 of top panel 300. Thus, projection 310 may be elevated relative to top surface 302 of top panel 300, e.g., on which annular burner body 210 rests. In particular, projection 310 may extend upwardly from top surface 302 of top panel 300 towards and/or into central combustion zone 212. Projection 310 may reduce the volume of central combustion zone 212, e.g., relative to flat top panel 142. Thus, less gaseous fuel may pool within central combustion zone 212 prior to ignition of the gaseous fuel and the ignition "pop" noise may be reduced or eliminated.

Central combustion zone 212 may also be positioned concentrically with projection 310. For example, central combustion zone 212 and projection 310 may have a generally circular cross-section in a plane that is perpendicular to vertical, and the circular cross-sections of central combustion zone 212 and projection 310 may be positioned concentric with each other. Such positioning of central combustion zone 212 and projection 310 may cause the gaseous fuel within central combustion zone 212 to swirl above projection 310, and the swirling pattern may encourage the collected gaseous fuel to deflect out and away from central combustion zone 212. Thus, less gaseous fuel may pool within central combustion zone 212 prior to ignition of the gaseous fuel and the ignition "pop" noise may be reduced or eliminated.

Projection 310 may be an embossment formed in top panel 300, e.g., by plastically deforming top panel 300 in a mold or press. When projection 310 is an embossment, projection 310 may have a frusto-conical shape, as shown in FIG. 11. In alternative example embodiments, projection 310 may be a separate piece of material mounted or resting on top panel 300. Projection 310 may also be imperforate directly below central combustion zone 212. Thus, spills passing through central combustion zone 212 may collect on top panel 300 at projection 310 and not flow through top panel 300 at projection 310. A user may easily access and clean such spills on top panel 300 by removing annular burner body 210 from top panel 300.

Figure 12:
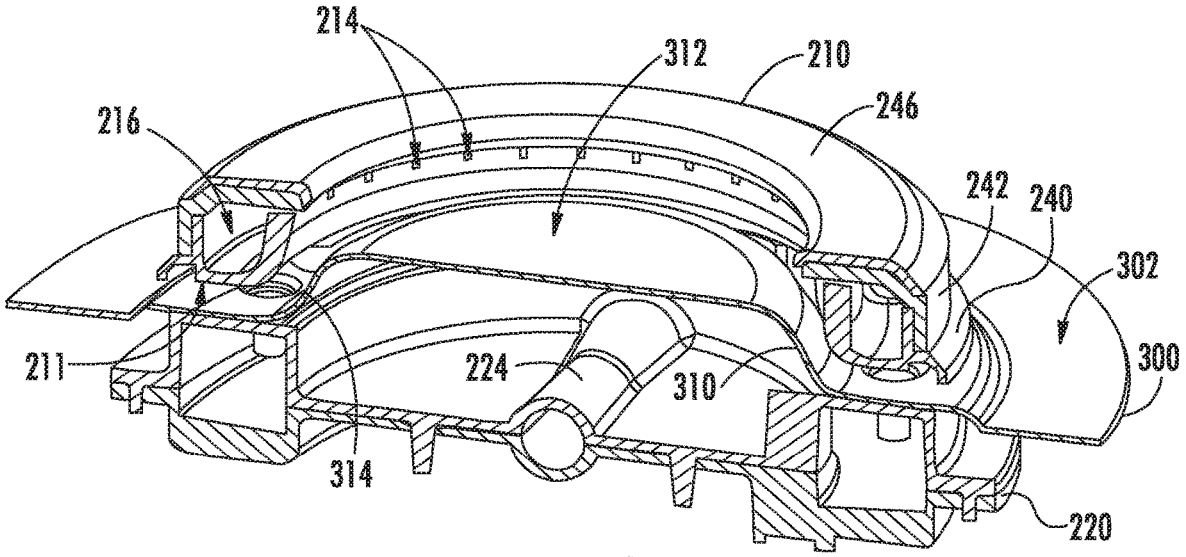
FIG. 12 provides a perspective, section view of the example top panel and gas burner assembly of FIG. 10.
Figure 13:
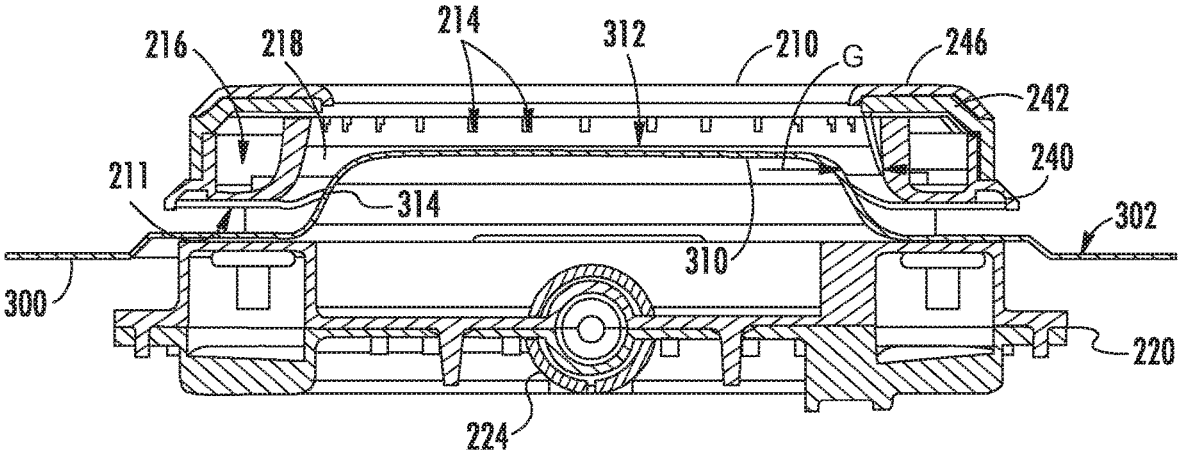
FIG. 13 provides a side, section view of the example top panel and gas burner assembly of FIG. 10.

FIG. 12 provides a perspective, section view of top panel 300 and burner assembly 200. FIG. 13 provides a side, section view of top panel 300 and burner assembly 200. As may be seen in FIGS. 12 and 13, a distal end portion 312 of projection 310 is spaced from top surface 302 of top panel 300. As an example, a distal end portion 312 of projection 310 may be spaced from top surface 302 of top panel 300 by no less than a quarter of an inch and no more than two inches. Such sizing of projection 310 may reduce the volume of central combustion zone 212 relative to a flat top panel and thus limit pooling of gaseous fuel within central combustion zone 212 prior to ignition of the gaseous fuel and thereby reduce or eliminate ignition "pop" noise. Distal end portion 312 of projection 310 may be flat or planar in certain example embodiments, as shown in FIGS. 11 and 13. In such example embodiments, the flat distal end portion 312 of projection 310 may be parallel to top surface 302 of top panel 300 and/or outer surface 248 of annular burner cap 246.

Distal end portion 312 of projection 310 may also be positioned below flame ports 214 within central combustion zone 212. Such positioning of projection 310 may reduce flame impingement against projection 310 during operation of gas burner assembly 200. Thus, heating of projection 310 by flames at flame ports 214 may be reduced by positioning distal end portion 312 of projection 310 below flame ports 214 within central combustion zone 212.

As shown in FIGS. 12 and 13, a bottom surface 211 of annular burner body 210 may be spaced from top surface 302 of top panel 300. Thus, air may be flowable under annular burner body 210 into central combustion zone 212 via a gap between the annular burner body 210 and top panel 300. Distal end portion 312 of projection 310 may be positioned above bottom surface 211 of annular burner body 210. In addition, projection 310 may be spaced from inner side wall 218 of annular burner body 210 by an annular gap G. It will be understood that a size of the gap G may vary along the axial direction A or vertically. Thus, the annular gap G labeled in FIG. 13 may correspond to a minimum value of the general gap between projection 310 and inner side wall 218 of annular burner body 210. Air is flowable under annular burner body 210 and through the annular gap G into central combustion zone 212. Thus, projection 310 may have sloped walls 314 that are spaced from annular burner body 210 by the annular gap G. The annular gap G may facilitate induction of secondary air and ensure good combustion is maintained within central combustion zone 212 relative to known inward firing gas burners.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel having a projection that extends upwardly from a top surface of the top panel; and a gas burner assembly positioned at the top panel, the gas burner assembly comprising an annular burner body positioned on the top panel at the top surface of the top panel, the annular burner body defining a central combustion zone, the annular burner body also defining a plurality of flame ports at the central combustion zone, gaseous fuel flowable from a fuel chamber within the annular burner body into the central combustion zone through the plurality of flame ports, wherein the central combustion zone is positioned concentrically with the projection of the top panel, and the annular burner body is open at the central combustion zone such that the projection is exposed through the annular burner body at the central combustion zone, and wherein the projection extends upwardly into the central combustion zone.

2. The cooktop appliance of claim 1, wherein the projection is an embossment formed in the top panel.

3. The cooktop appliance of claim 2, wherein the embossment has a frusto-conical shape.

4. The cooktop appliance of claim 1, wherein the projection is imperforate.

5. The cooktop appliance of claim 1, wherein a distal end portion of the projection is spaced from the top surface of the top panel no less than a quarter of an inch and no more than two inches.

6. The cooktop appliance of claim 1, wherein a distal end portion of the projection is positioned below the plurality of flame ports.

7. The cooktop appliance of claim 1, wherein a bottom surface of the annular burner body is spaced from the top surface of the top panel such that air is flowable under the annular burner body into the central combustion zone.

8. The cooktop appliance of claim 5, wherein a distal end portion of the projection is positioned above the bottom surface of the annular burner body.

9. The cooktop appliance of claim 5, wherein the projection is spaced from an inner side wall of the annular burner body by an annular gap, the air flowable under the annular burner body and through the annular gap into the central combustion zone.

10. The cooktop appliance of claim 1, wherein no portion of the annular burner body is positioned within the central combustion zone above projection of the top panel.

11. The cooktop appliance of claim 1, wherein the gas burner assembly further comprises a fuel manifold, the annular burner body connectable to the fuel manifold such that the gaseous fuel is flowable from the fuel manifold into the fuel chamber of the annular burner body, the fuel manifold having a plurality of outlet passages, the gaseous fuel flowable through the plurality of outlet passages into the fuel chamber of the annular burner body.

12. The cooktop appliance of claim 11, wherein the plurality of outlet passages extend through the top panel towards the annular burner body, the plurality of outlet passages distributed about the central combustion zone.

13. The cooktop appliance of claim 12, wherein the gas burner assembly further comprises a plurality of inlet passages, each inlet passage of the plurality of inlet passages engaging a respective one of the plurality of outlet passages of the fuel manifold such that the gaseous fuel is flowable from the plurality of outlet passages of the fuel manifold into the fuel chamber of the annular burner body through the plurality of inlet passages.

14. The cooktop appliance of claim 13, wherein the annular burner body is suspended over the top panel on the plurality of inlet passages such that air is flowable under the annular burner body into the central combustion zone.

15. A cooktop appliance, comprising:

a top panel having a projection that extends upwardly from a top surface of the top panel; and a gas burner assembly positioned at the top panel, the gas burner assembly comprising an annular burner body positioned on the top panel at the top surface of the top panel, the annular burner body defining a central combustion zone, the annular burner body also defining a plurality of flame ports at the central combustion zone, the plurality of flame ports positioned proximate an inner side wall of the annular burner body, gaseous fuel flowable from a fuel chamber within the annular burner body into the central combustion zone through the plurality of flame ports, a bottom surface of the annular burner body spaced from the top surface of the top panel such that air is flowable under the annular burner body into the central combustion zone, wherein a distal end portion of the projection is positioned above the bottom surface of the annular burner body, the projection is spaced from the inner side wall of the annular burner body by an annular gap, and the air is flowable under the annular burner body and through the annular gap into the central combustion zone, wherein the annular burner body is open at the central combustion zone such that the projection is exposed through the annular burner body at the central combustion zone, and wherein the projection extends upwardly into the central combustion zone.

16. The cooktop appliance of claim 15, wherein the projection is an embossment formed in the top panel.

17. The cooktop appliance of claim 16, wherein the embossment has a frusto-conical shape.

18. The cooktop appliance of claim 15, wherein a distal end portion of the projection is spaced from the top surface of the top panel no less than a quarter of an inch and no more than two inches.

19. The cooktop appliance of claim 15, wherein a distal end portion of the projection is positioned below the plurality of flame ports.

20. The cooktop appliance of claim 15, wherein no portion of the annular burner body is positioned within the central combustion zone above projection of the top panel.

* * * * *